United States Patent [19]

Tennis

[11] 4,036,245

[45] July 19, 1977

[54] PRESSURE COMPENSATED HYDRAULIC CONTROL VALVE

[75] Inventor: Francis Henry Tennis, Oconomowoc, Wis.

[73] Assignee: Sundstrand Corporation, Rockford, Ill.

[21] Appl. No.: 645,203

[22] Filed: Dec. 29, 1975

[51] Int. Cl.[2] ..... F15B 13/08

[52] U.S. Cl. ..... 137/117; 137/596.12

[58] Field of Search ..... 137/117, 596.12, 596.13

[56] References Cited

U.S. PATENT DOCUMENTS

| | | | |
|---|---|---|---|
| 3,722,543 | 3/1973 | Tennis | 137/596.12 |
| 3,771,558 | 11/1973 | Ailshie | 137/596.13 |

FOREIGN PATENT DOCUMENTS

| | | | |
|---|---|---|---|
| 2,335,702 | 1/1974 | Germany | 137/596.13 |
| 2,308,376 | 5/1974 | Germany | 137/596.13 |

*Primary Examiner*—Alan Cohan
*Assistant Examiner*—Gerald A. Michalsky
*Attorney, Agent, or Firm*—Ira Milton Jones & Associates

[57] ABSTRACT

A pressure compensating valve mechanism for a hydraulic control valve, having a port through which excess supply fluid is diverted to tank by the valve element thereof in any metering position of the control valve spool. A pressure control mechanism connected with the excess fluid port of the pressure compensating valve mechanism governs flow of excess fluid to tank and minimizes jet forces on the pressure compensating valve element to thereby assure the desired precise control over the motor governed by the control valve.

15 Claims, 2 Drawing Figures

Figure 1:
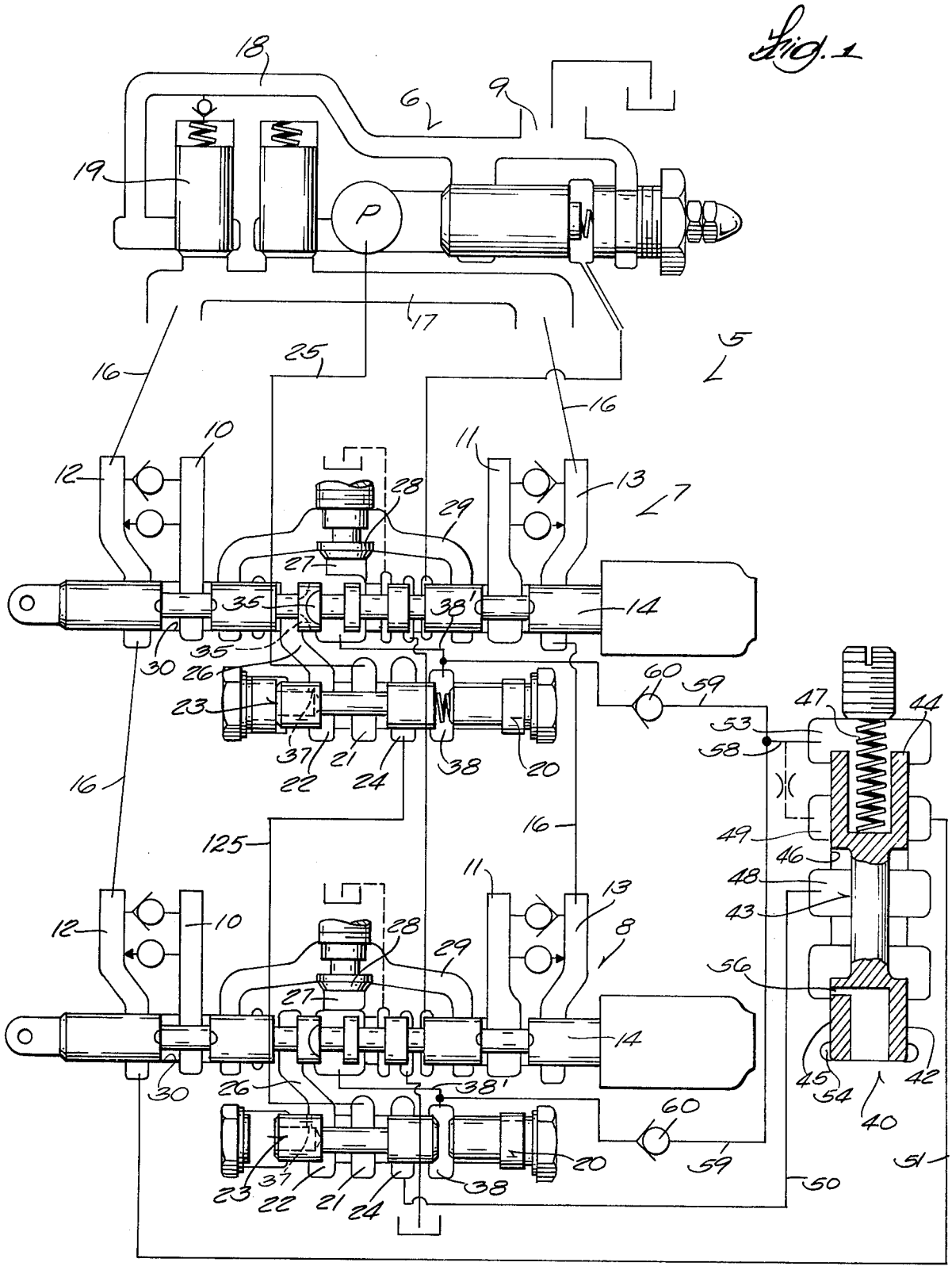

18
6
9
19
P
17
5
16
25
10
11
12
13
7
28
29
27
35
38'
14
30
26
60
59
23
47
44
53
58
37
21
22
24
38
20
49
46
48
43
125
8
56
45
54
42
40
51
50

18
6
9
19
P
17
5
16
25
10
11
16
78
12
13
7
27
28
29
14
35
35
30
26
38'
23
37
22
21
24
38
20
79
82
71
16
125
83
80
10
11
13
12
8
28
29
85
27
81
14
30
35
38'
26
20
73
70
23
37
22
21
24
38
50
74
72
51
77
75

PRESSURE COMPENSATED HYDRAULIC CONTROL VALVE

This invention relates to pressure compensating valve mechanism such as are used with hydraulic motor control valves to assure precise control over the speed of the governed motor in any metering position of the control valve spool.

As is well known, such pressure compensating valve mechanisms are provided with a differential pressure responsive spool type of valve plunger, which automatically maintains a uniform pressure drop across the orifice defined by the control valve spool in any metering position thereof, to thus assure operation of the governed motor at a constant speed corresponding to the setting of the valve spool.

In order to perform in this manner, the compensating plunger must automatically adjust itself in accordance with variations in the load on the governed motor and effect bypass to tank of whatever amounts of supply fluid will maintain the desired pressure drop across the orifice defined by the control valve spool.

Accordingly, the pressure compensating valve mechanism is provided with a bypass or excess fluid port to which its plunger can divert supply fluid in bypass relation to the control valve spool. It is also customarily provided with an inlet to receive pressure fluid from the supply passage of the control valve, a use port to which its plunger can divert inlet fluid for flow to the control valve spool, and a signal or load pressure port which is maintained at a pressure corresponding to that of fluid at the motor port of the control valve.

Rising load pressure forces imposed upon one end of the compensating plunger tends to move it in a direction that limits bypass of inlet fluid out of the compensating valve, and as a consequence, increases pressure at its use port. Rising inlet pressure imposed upon the other end of the compensating plunger tends to move it in the opposite direction to increase bypass flow out of the excess fluid port, and as a consequence, reduces pressure at the use port.

Inasmuch as the plunger of the compensating valve mechanism functions to divert supply fluid entering its inlet to the bypass or excess fluid port, it is inevitable that the plunger will be subjected to axial jet forces which can seriously interfere with the desired precise control over the speed of the governed motor. Moreover, these jet forces are most severe in those metering positions of the control valve spool at which accurate control over the governed motor at slow speeds is imperative. In these "slow speed" positions of the control valve spool, the pressure drop across the compensating plunger is greatest, and the axial jet forces acting upon the plunger and tending to shift the same are correspondingly highest. Accordingly, the compensating plunger can be rendered objectionably unstable under the influence of such jet forces.

With this problem in mind, it is the purpose of this invention to provide pressure control means for a pressure compensating valve mechanism which functions to exert a substantial stabilizing effect upon the plunger of the compensating valve mechanism.

More specifically, it is an object of the invention to provide a pressure compensating valve mechanism with pressure control means which acts to maintain a substantially uniform low pressure drop across the compensating plunger in any metering position of a control valve with which said mechanism is associated, to thereby assure the desired stability of the plunger and precise control over the motor governed by the control valve.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

Figure 2:
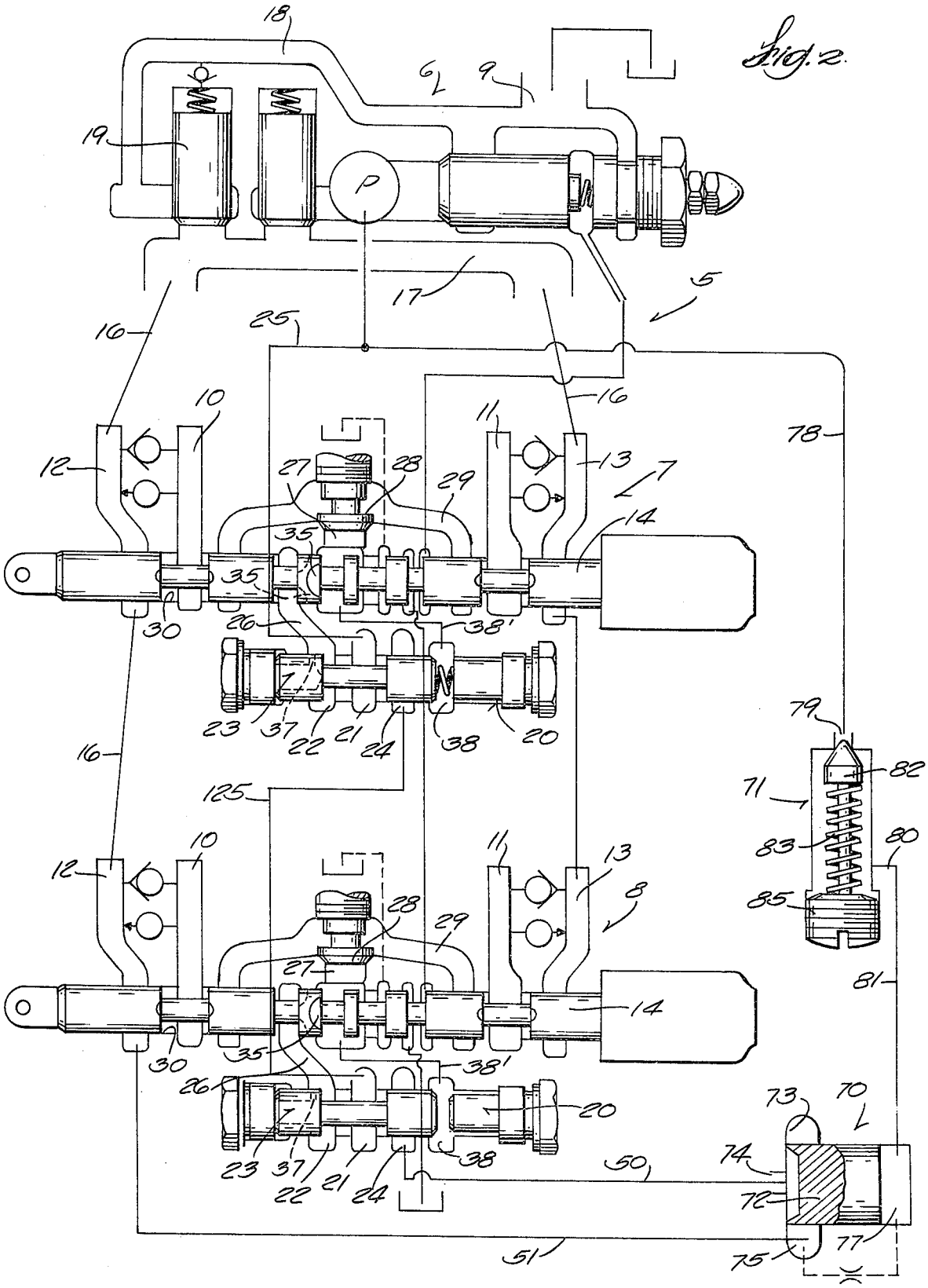

The accompanying drawings illustrate two complete examples of the embodiments of the invention constructed according to the best modes so far devised for the practical application of the principles thereof, and in which:

FIG. 1 is a diagrammatic representation of the pressure compensating and pressure control mechanisms of this invention, shown connected to a two-spool hydraulic motor control valve; and FIG. 2 is a view similar to FIG. 1 but illustrating a modified embodiment of the invention.

Referring now to the accompanying drawings, the numeral 5 generally designates a hydraulic control valve of the type disclosed in my U.S. Pat. No. 3,722,543, issued Mar. 27, 1973. Since reference to that Patent may be had for a complete description of the control valve, only a general discussion thereof follows.

The control valve has been shown as comprised of an end section 6, an upstream motor control section 7, and a downstream motor control section 8. The end section 6 is provided with an inlet P to receive pressure fluid from a pump or other source of fluid under pressure, and it has a tank port 9 through which motor exhaust fluid can be returned to a reservoir.

Each motor control section is provided with a pair of motor ports 10 and 11 for connection with the opposite sides of a reversible fluid motor, and a pair of exhaust ports 12 and 13, one for each of the motor ports 10 and 11, respectively. A valve spool 14 in each control section is movable from a neutral or hold position shown, to operating positions at opposite sides of neutral to effect communication of either of its motor ports with the inlet P while at the same time effecting communication of the non-selected motor port with its associated exhaust port.

Motor exhaust fluid from either motor port 12 or 13 is conducted through exhaust passage means 16 to an exhaust header 17 before flowing to an exhaust passage 18 leading to the tank port 9. A low pressure relief valve 19 serves to communicate the exhaust header with the exhaust passage 18 for reasons explained at length in my aforesaid patent, and of no importance to the invention hereinconcerned.

Each control section has its own pressure compensating valve mechanism 20. Each such mechanism has an inlet port 21 to receive source fluid, a use port 22 through which pressure fluid must flow before passing on to its associated control valve, and a fluid pressure actuatable spool-type plunger 23 for diverting source fluid entering its inlet to either its use port or to an excess fluid port 24 through which source fluid can flow in bypass relation to its use port and the associated control valve.

The inlet port 21 of the upstream valve mechanism 20 is connected to the inlet P by a supply passage 25, while the inlet port of the downstream valve mechanism 20 is connected to the bypass port 24 of the upstream pressure compensating valve mechanism by a supply passage 125. Hence when both valve spools 14 are in their neutral positions shown, source fluid can flow from port P serially through both pressure compensating valve mechanisms to tank, in bypass relation to both control valve spools. The manner in which source fluid issuing from the bypass port of the downstream pressure compensating valve mechanism flows to tank will be explained hereinafter.

When the valve spool in either control section 7 or 8 is actuated to a working position, source fluid is caused to flow from supply passage 25 (or 125) to the selected motor port 10 or 11 via use port 22 of its associated pressure compensating valve mechanism. Hence, either supply passage 25 or 125 can be considered as providing the inlet branch of supply passage means for its associated control valve section.

Each such supply passage means is provided with a second branch 26 which connects the use port 22 of its compensating valve mechanism with the bore 30 containing the associated valve spool 14. A third branch 27 of the supply passage means leads from the bore 30 through a load holding check valve 28 to a bridge passage 29 which can be considered as the fourth branch of the supply passage means for each section.

The bridge passage 29 communicates with the bore 30 at locations adjacent to its junctions with the motor ports 10 and 11, and each of the latter serves as the downstream extremity of the supply passage means for its associated valve section when communicated with the bridge passage and the inlet P by the valve spool 14.

Each compensating valve mechanism functions to maintain a uniform pressure drop across its associated valve spool 14 when the latter is actuated to a metering position affording limited communication between the associated second and third branches 26 and 27 of the supply passage means through one or more metering notches 35 in the valve spool. This is to say that the valve spool then defines an orifice through which pressure fluid flows to the selected motor port.

The pressure of supply fluid at the upstream side of the spool-defined orifice, for example in branch 26 of the supply passage means, is imposed upon the left hand end of the compensating plunger 23 in the customary manner, as through a supply port 37 in the plunger, and tends to shift the plunger to the right to restrict communication between its inlet and use ports 21 and 22, respectively, while at the same time increasing the degree of communication between the inlet port and the bypass port 24. As will be explained more fully later on, this allows more supply fluid from the inlet port 21 to flow to tank, in bypass relation to the use port 22, to correspondingly decrease the pressure at the use port.

Also as is customary during operation, pressure at a value corresponding to that of fluid issuing from either motor port is imposed upon the right hand end of the compensating plunger, through a signal or feedback port 38. Such feedback fluid pressure tends to shift the compensating plunger 23 to the left, with a force depending upon the load on the governed motor. When the plunger shifts to the left, as occurs during times when the load on the motor increases, the plunger restricts bypass flow of supply fluid to the excess fluid port 24 to thus cause an increase in pressure at the use port 22.

In the present case, the feedback port 38 comprises a chamber containing the right hand end of the compensating plunger, which chamber is communicated with the supply passage branch 27 by means of a signal passage 38'.

As is well known, the pressure compensating valve mechanism can thus respond to variations in pressure drop across the throttle or orifice defined by the valve spool in the metering positions thereof, to cause the pressure at the use port to increase or decrease in correspondence with increase and decrease in the load on the governed motor. In this way, the speed of the governed motor can be held substantially constant, at values corresponding to the setting of the valve spool governing motor operation.

In the past, however, precise control over motor speed with the desired degree of accuracy was seriously interfered with due to response of the compensating plunger to fluid pressure forces other than those imposed upon its opposite ends as described above. Such other forces are those commonly referred to as jet forces, which act upon surface areas of the plunger at its centrally grooved portion. These jet forces are ordinarily generated in consequence of the great pressure differentials that obtain between the inlet and bypass ports 21 and 24 in the metering positions of the valve spool 14. At such times, of course, much of the supply fluid entering the inlet port 21 flows to the excess fluid port 24, in bypass relation to the use port 22. Moreover, these jet forces on the plunger increase in accordance with increase in the degree of communication between the inlet and bypass ports 21 and 24; which is to say that they have a serious unstabilizing effect upon the plunger which increases as the pressure at the use port decreases.

The present invention solves this problem of compensating plunger instability through the provision of a pressure control mechanism 40 which acts to substantially eliminate jet forces on the plunger. As will now be discussed, the pressure control mechanism 40 performs this important function by minimizing the pressure differential between the compensator inlet and bypass ports 21 and 24 in any position the compensating plunger may occupy during operation of a system governed by the control valve.

The pressure control mechanism 40 seen in FIG. 1 comprises an elongated spool type of valve member 42 having a central circumferential groove 43 which defines a pair of lands 44 and 45, one at each end of the valve member. The valve member 42 is slidable endwise in a bore 46. A spring 47 acts on one end of the valve member and tends to maintain it in what can be considered a closed limit of motion, at which its land 44 blocks communication between two ports 48 and 49 which open to the bore 46 at axially spaced locations. The port 48 provides an inlet which is communicated with the bypass port 24 of the downstream valve section 8 by a duct or passage 50. The other port 49 is connected by a duct or passage 51 with the exhaust passage means 16, and thus provides a tank port.

Pressure chambers 53 and 54 which are defined by the opposite ends of the bore 46, respectively receive the lands 44 and 45 on the ends of the valve member 42. The chamber 54 is at all times communicated with the inlet 48 through the hollow interior of the land 45 and a radial hole 56 in the wall of land 45 leading to its interior. Accordingly, chamber 54 will be maintained at a pressure corresponding to that of the bypass port 24 of the compensating valve mechanism for downstream valve section 8.

It is to be understood, of course, that the valve plunger in either pressure compensating valve mechanism will be held in a full bypass open position by the pressure of supply fluid acting on its left-hand whenever its associated valve spool 14 is in neutral position. Hence, if the spool 14 in the downstream valve section 8 is in neutral, the chamber 54 of the pressure control mechanism 40 will mirror the pressure at the bypass port 24 of the upstream compensating valve mechanism at times when its associated valve spool is in an operating position.

In the event both valve spools 14 are in neutral, supply fluid will flow serially through the bypass ports 24 of both compensator mechanisms to the inlet 48 of the pressure control mechanism 40. Supply fluid then entering inlet 48 will flow into chamber 54 and exert force on the valve member 42 sufficient to move it to open position against the force of its spring 47, to freely allow fluid from its inlet 48 to flow to the tank port 49.

The other pressure chamber 53, in which land 44 is received, is communicated with the signal ports 38 of both pressure compensating valve mechanism by a passage 58 having branches 59 connecting with the signal passages 38' leading to said ports. Check valves 60, one in each branch 59, assure pressurization of the signal chamber 53 with the higher of the pressures present in the pressure compensator signal ports 38 if the spools in both control valve sections happen to be in working positions at the same time.

The operation of the pressure control mechanism 40 can be readily appreciated if it is assumed that the spool in the upstream control section 7 is in neutral, while the spool 14 in the downstream control section 8 is in a partial working position metering flow of source fluid to one or the other of its motor port 10 or 11. All of the fluid from inlet P then flows through the port 24 of the upstream pressure compensating valve mechanism in bypass relation to the spool in valve section 7, and enters the inlet port 21 of the pressure compensating valve mechanism for the downstream control valve section 8. Depending upon the metering position of the spool 14 in said downstream section 8, the plunger of the associated pressure compensator will be held in a position directing part of such inlet fluid to its use port 22 for flow to the selected motor port 10 or 11, and the remainder of the inlet fluid to the bypass port 24 for flow to the tank port 44 under the control of the valve member 42 in the pressure control mechanism 40.

At such a time, the position of the compensating plunger 23 will, of course, be determined by the fluid pressure forces exerted upon its opposite ends. In any given metering position of the compensating plunger, the pressure at the inlet port 21 of the compensator mechanism heretofore was always greatly in excess of the pressure at its bypass port 24. This condition was responsible for the imposition of undesirable jet forces on the compensating plunger, and consequent interference with the ability of the compensator to function in its intended manner.

According to this invention, however, the discharge of excess supply fluid from the bypass port 24 is restricted by the pressure control mechanism 40 to a degree that assures a desirably low pressure differential between the inlet and bypass ports 21 and 24 in any metering position of the compensating plunger.

The pressure control mechanism operates to perform this important function by reason of the fact that the pressure of fluid in supply passage branch 27 of the downstream valve section 8 is imposed upon the land 44 of control valve member 42 in signal chamber 53 and cooperates with spring 47 to urge the valve member 42 toward a position closing off flow to tank port 49 of bypass fluid issuing from the excess fluid port 24 of the pressure compensating valve mechanism. This closing force on the valve member, however, is opposed by the force which pressure fluid from the excess fluid port 24 imposes on the end of the valve member in chamber 54. Valve member 42 will not move in the opening direction, to open its inlet 48 to the tank port 49, until the pressure at the excess fluid port 24 builds up to a value close to that of fluid in the supply passage branches 125 and 27, and accordingly in signal port 38 of the pressure compensator. The force of the spring 47, of course, is so chosen as to allow bypass fluid to flow to the tank port 49 at such times as the pressure differential across the compensating plunger 23 is at a value low enough to assure the elimination of undesirable jet forces on the plunger.

The pressure control mechanism 42 will function in this manner in all metering positions of the compensating plunger; it being understood that its valve member 42 will be modulated by variations in pressure differential between its inlet and signal ports 48 and 53, respectively, to in turn correspondingly vary the degree of communication between the inlet and tank ports 48 and 49, respectively. As a result, the pressure control mechanism will function to maintain a uniform low pressure differential across the compensating plunger 23, to assure the desired precise control over the governed motor.

In the modified embodiment of the invention seen in FIG. 2, the pressure control mechanism comprises a poppet valve mechanism generally designated 70 and a low pressure relief valve 71. The poppet valve member 72 is slidable axially toward and from a closed position of engagement with a seat 73, at which it blocks fluid flow from the inlet 74 of the valve to the tank port 75 thereof.

The inlet 74 of the valve is communicated with the bypass port 24 of the downstream pressure compensator by a passage 50, and the tank port 75 is communicated with the exhaust passage means 16 by a passage 51, as before. The pressure of bypass fluid discharging from the excess fluid port 24 of the downstream compensator will thus again exert opening force upon the poppet 72 of the valve mechanism 70.

The space 77 in the poppet compartment behind the poppet provides a pressure chamber for supply fluid which corresponds to the chamber 53 of FIG. 1 embodiment of the invention. Chamber 77 is communicated with the supply passage means of control valve 5 through the low pressure relief valve mechanism 71. For this purpose, a duct or passage 78 is provided to afford communication of supply passage 25 with the inlet 79 of the low pressure relief valve. The outlet 80 of the relief valve is communicated with the pressure chamber 77 of the poppet valve via a duct or passage 81. The low pressure relief valve member 81 is urged toward a position closing the inlet 79 by a spring 83 which, for example, may exert a closing pressure on the order of 50 p.s.i. on the valve member 82.

The closing force which the spring 83 exerts upon the valve member 82 can be varied by means of a screw 85, which provides an adjustable seat for one end of the spring. With a spring force as given above, the relief valve 71 serves to maintain the pressure of supply fluid in poppet chamber 77 at about 50 p.s.i. below the pressure at the inlet P whenever the relief valve is open.

With the valve mechanism described, the pressure at the inlet P will more or less mirror the pressure at the motor ports, and thus will be influenced by load pressure to increase or decrease with increasing and/or decreasing load on the governed motor. The poppet 72 will accordingly respond to the differential in pressure between its inlet port 74 and chamber 77 and be held thereby in whatever position restricts bypass flow out of the excess fluid port 24 of the downstream compensator the extent necessary to minimize the pressure drop across the associated compensating plunger and hold the same at a uniform value. As a result, jet forces on the compensating plunger 23 will be minimized, and optimum stability of the plunger assured.

FIG. 2 embodiment of the invention is otherwise generally the same as that illustrated in FIG. 1. The main difference is that the pressure control mechanism 70, 71 is connected directly between the control valve inlet P and the outlet thereof provided by the bypass port 24 of the downstream compensator 20.

From the foregoing description together with the accompanying drawings, it will be readily apparent to those skilled in the art that this invention provides pressure compensating valve mechanism and pressure control valve means therefor by which exceptional stability of the compensating plunger is assured.

Those skilled in the art will appreciate that the invention can be embodied in forms other than as herein disclosed for purposes of illustration.

The invention is defined by the following claims:

I claim:

1. A control valve having a valve element movable to a working position to effect flow of pressure fluid from a source to a motor port via high pressure passage means which comprises a feeder passage that extends across the valve element, and having low pressure passage means for connection with a reservoir, said control valve being characterized by:

A. pressure compensating valve means having a fluid pressure responsive plunger movable in a bore to so regulate flow of source fluid to the feeder passage as to tend to maintain a substantially constant pressure drop across the valve element in its said working position, and having an excess fluid port to which supply fluid can be bypassed in amounts depending upon the position of the plunger in its bore;

B. and plunger stabilizing means comprising a valve mechanism having an inlet port connected with said excess fluid port, an outlet connected with the low pressure passage means and connectable with the inlet port, a signal port connected with the high pressure passage means, a pressure responsive valve member to control communication between the inlet port and the outlet, and means to so effect actuation of said valve member in response to variations in the differential between inlet and signal port pressures that the valve member will be caused to move in a direction to increasingly restrict communiction between the inlet port and the outlet in accordance with increasing signal port pressure, and so that the valve member will be caused to move in the non-restricting direction in consequence of increasing inlet port pressure.

2. A control valve of the type having a valve element to selectively connect a motor port with low pressure passage means or with high pressure passage means that extends across the valve element and through an orifice defined thereby in a partial working position of said element, characterized by:

A. a pressure compensating valve device through which high pressure fluid must flow to reach the motor port, having an excess fluid port through which high pressure fluid can flow in bypass relation to the motor port, and having a valve plunger to proportion flow of high pressure fluid to the motor and excess fluid ports in accordance with variations in the pressure drop across said orifice, said pressure compensating valve device being arranged so that it tends to maintain a substantially constant pressure drop across said orifice;

B. an excess fluid flow control mechanism having an inlet connected with said excess fluid port, an outlet connected with the low pressure passage means, and fluid pressure responsive valve means to regulate communication between the inlet and the outlet;

C. and means operable in said working position of the control valve element to render said valve means responsive to variations in the pressure differential between fluid at said excess fluid port and fluid in the high pressure passage means, to thereby effect movement of said valve means in a direction to increasingly restrict communication between the inlet and the outlet in accordance with increasing pressure in the high pressure passage means, and to effect movement of the valve means in the non-restricting direction in consequence of increasing pressure at the excess fluid port.

3. The control valve of claim 2, further characterized by:

A. a feeder passage which provides for flow of pressure fluid from the pressure compensating valve device to the motor port in said working position of the control valve element;

B. and the valve means of said excess fluid flow control mechanism being subject to pressure of fluid in said feeder passage.

4. The control valve of claim 2, further characterized by:

A. said excess fluid flow control mechanism having valve means comprising a spool movable axially in a bore and having opposite piston-like ends disposed in pressure chambers, one at each end of the bore;

B. one of said chambers being connected with the high pressure passage means;

C. and the other of said chambers being connected with said excess fluid port.

5. The control valve of claim 4, further characterized by means providing restricted communication between said one chamber and the outlet of the excess fluid flow control mechanism.

6. The control valve of claim 4, further characterized by spring means acting upon said spool to urge the same in said restricting direction.

7. The control valve of claim 6, further characterized by means for adjusting the force which said spring means exerts upon said spool.

8. The control valve of claim 2, further characterized by:

A. there being duplicated first and second such control valves along with a separate pressure compensating valve device for each;

B. the second pressure compensating valve device having a supply port from which pressure fluid can be directed to the second motor port in the working position of the second valve element via second high pressure passage means extending across said second valve element, and having its excess fluid port connected with the inlet of the excess fluid flow control mechanism;

C. and the excess fluid port of the first pressure compensating valve device being connected to the supply port of the second pressure compensating valve device, and being connectable with the outlet of the excess flow control mechanism via the excess fluid port of the second pressure compensating valve device.

9. The control valve of claim 8, further characterized by separate check valve controlled passage means for subjecting the valve means of the excess flow control mechanism to the pressure of fluid in portions of the high pressure passage means which reflect load influenced pressure at the motor port of each control valve.

10. The control valve of claim 9, further characterized by:

A. a feeder passage for each control valve, providing for flow of pressure fluid to its motor port from the associated pressure compensating valve device;

B. and said check valve controlled passage means connecting with said feeder passages.

11. In combination with a hydraulic control valve:

A. a pressure compensating valve device having a supply port for high pressure supply fluid, a use port through which such supply fluid can issue for flow to the control valve, an excess fluid port to which fluid from the supply port can flow in bypass relation to the use port, and a valve member by which part of the high pressure fluid entering the supply port can be diverted to the use port and the remainder can be diverted to said excess fluid port, in bypass relation to the use port, in quantities such as to tend to maintain a substantially constant pressure drop across said control valve;

B. an excess fluid flow control mechanism having an inlet connected with said excess fluid port, an outlet for connection with a reservoir, and fluid pressure responsive valve means to control flow of fluid from the inlet to the outlet;

C. and means to render said valve means responsive to variations in the pressure differential between supply fluid and fluid at said excess fluid port, to thereby effect movement of said valve means in a direction to restrict communication between the inlet and outlet in consequence of rise in the pressure of supply fluid, and to effect movement of said valve means in the non-restricting direction in consequence of rise in the pressure of fluid at the excess fluid port.

12. In combination with a hydraulic control valve having high pressure passage means through which supply fluid from a source thereof can flow to a motor port governed by the valve;

A. a pressure compensating valve device having a supply port connected with said high pressure passage means, an excess fluid port to which supply fluid from the high pressure passage means can flow in bypass relation to the control valve, and a valve member to regulate said bypass flow and thereby determine the amount of supply fluid which can flow from the high pressure passage means to said motor port, said valve member being so arranged as to tend to maintain a substantially constant pressure drop across said control valve in positions thereof at which it restricts flow of fluid from said source to said motor port;

B. an excess fluid flow control mechanism having an inlet connected with said excess fluid port, a reservoir port, and fluid pressure responsive valve means to control communication between the inlet and the reservoir port;

C. and means for actuating said valve means in response to variations in the pressure differential between fluid in the high pressure passage means and fluid at the excess fluid port, so as to effect movement of said valve means in the direction to restrict communication between the inlet and the reservoir port in consequence of rise in pressure in the high pressure passage means, and to effect movement of said valve means in the non-restricting direction in consequence of rise in the pressure of fluid at said excess fluid port.

13. In combination with a pressure compensating valve mechanism having pressure fluid use and feedback ports for connection with a control valve, a pressure fluid supply port, an excess fluid port, and a pressure sensitive valve member to regulate flow of supply fluid to the use and excess fluid ports in accordance with variations in the pressure differential between the supply and feedback ports and in proportions that tend to maintain said pressure differential substantially constant, means for reducing jet forces on said valve member, comprising:

A. a valve mechanism through which fluid from the excess fluid port can be returned to a reservoir, said valve mechanism having an inlet connected with the excess fluid port, a reservoir port, and a fluid pressure actuatable valve element to control flow of fluid from the inlet to the reservoir port;

B. and means for effecting actuation of said valve element in the flow restricting direction in consequence of variation in the pressure differential between the supply and excess fluid ports that occurs whenever pressure at said supply port increases, and to effect actuation of said valve element in the non-restricting direction in consequence of variation in said last named pressure differential that occurs whenever pressure at the excess fluid port increases.

14. In combination:

A. a first pressure control mechanism having pressure fluid supply, use and feedback ports for connection with a control valve, an excess fluid outlet port, and a pressure sensitive valve member to regulate communication of the supply port with the use port and with the excess fluid outlet port in accordance with variations in the pressure differential between the supply and feedback ports and in proportions which tend to maintain said differential constant;

B. a second pressure control mechanism having an inlet connected with the excess fluid outlet port, a tank port, and a fluid pressure actuatable valve element movable in a closing direction toward a position blocking communication between the inlet and tank ports, and movable in the opening direction to increase communication between said inlet and tank ports;

C. and means to effect actuation of said valve element in the closing direction in consequence of variation in the pressure differential between the supply and excess fluid outlet ports that occurs whenever pressure at the supply port increases, and to effect actuation of said valve element in the opening direction in consequence of variation in said last named pressure differential that occurs whenever pressure at the excess fluid outlet port rises.

15. In combination with a control valve having a valve spool to govern flow of pressure fluid from a supply port to a motor port;

A. first and second pressure control mechanisms each having a valve member which is fluid pressure actuatable in opposite directions;

B. means defining a first passageway controlled by the valve spool, through which pressure fluid can flow from the supply port to the motor port;

C. means defining a second passageway through which pressure fluid from the supply port can flow to a tank port in bypass relation to the motor port, said second passageway leading serially through said first and second pressure control mechanisms to be controlled by the valve members thereof;

D. said first mechanism having an inlet connected with the fluid supply port, a use port from which supply fluid flows to the motor port, a feedback port which is maintained at a pressure corresponding to that of the motor port whenever supply fluid is flowing to said motor port, and an excess fluid port, and the valve member of said first mechanism being movable in opposite directions to govern communication of its inlet port with its said use and excess fluid ports in accordance with variations in the pressure differential between its inlet and feedback ports;

E. and said second mechanism having an inlet port connected with said excess fluid port, a tank port which is communicable with its said inlet port under the control of the valve member of said second mechanism, and having a signal port which is maintained at a pressure corresponding to that of fluid in said feedback port whenever supply fluid is flowing to the motor port, and the valve member of said second mechanism being movable in the direction to decreasingly restrict communication between its said inlet and tank ports in response to rise in the pressure of fluid at said excess fluid port and being movable in the opposite direction in response to rise in the pressure of fluid at said signal port.

* * * * *